US005813771A

United States Patent [19]

Ur et al.

[11] Patent Number: 5,813,771

[45] Date of Patent: Sep. 29, 1998

[54] METHOD AND APPARATUS FOR PRINTER/ SCANNER CALIBRATION

[75] Inventors: Shmuel Ur, Misgav; Eyal Yair, Givot Elgh, both of Israel

[73] Assignee: International Business Machines Corporation, Armonk, N.Y.

[21] Appl. No.: 762,899

[22] Filed: Dec. 10, 1996

[51] Int. Cl.[6] ..... B41J 11/64

[52] U.S. Cl. ..... 400/74; 400/68

[58] Field of Search ..... 400/68, 74, 103, 400/104; 101/181, 183, 248; 347/19, 116

[56] References Cited

U.S. PATENT DOCUMENTS

| | | | |
|---|---|---|---|
| 4,725,156 | 2/1988 | Proulx et al. | 400/630 |
| 4,795,281 | 1/1989 | Ulinski et al. | 400/74 |
| 4,960,336 | 10/1990 | Brooks et al. | 400/103 |
| 5,187,774 | 2/1993 | Ericson | 400/630 |
| 5,228,100 | 7/1993 | Takeda et al. | 382/175 |

FOREIGN PATENT DOCUMENTS

| | | | |
|---|---|---|---|
| 0438899 | 12/1990 | European Pat. Off. | 400/74 |

*Primary Examiner*—Edgar S. Burr
*Assistant Examiner*—Steven S. Kelley

[57] ABSTRACT

A method is described for calibrating a printer and/or a scanner so that information can be printed at a desired location with respect to a sheet, the method comprising: storing a first set of markings as a first image in digital form; printing, using a printer to be calibrated, the first image on a sheet to form a printed sheet; scanning the printed sheet to generate a second image stored in digital form; comparing the first image and the second image, or an image derived from the second image, to determine a first transformation which maps the first set of markings in the second image, or the image derived from the second image, onto the first set of markings on the first image; storing parameters of the first transformation for subsequent use by applying the first transformation to information to be printed at the desired location. Using this method the bias transformations associated with a printer and/or a scanner can be accurately measured and stored for future use in printing. The method finds particular application in a system for enabling the filling in of preprinted forms.

9 Claims, 11 Drawing Sheets

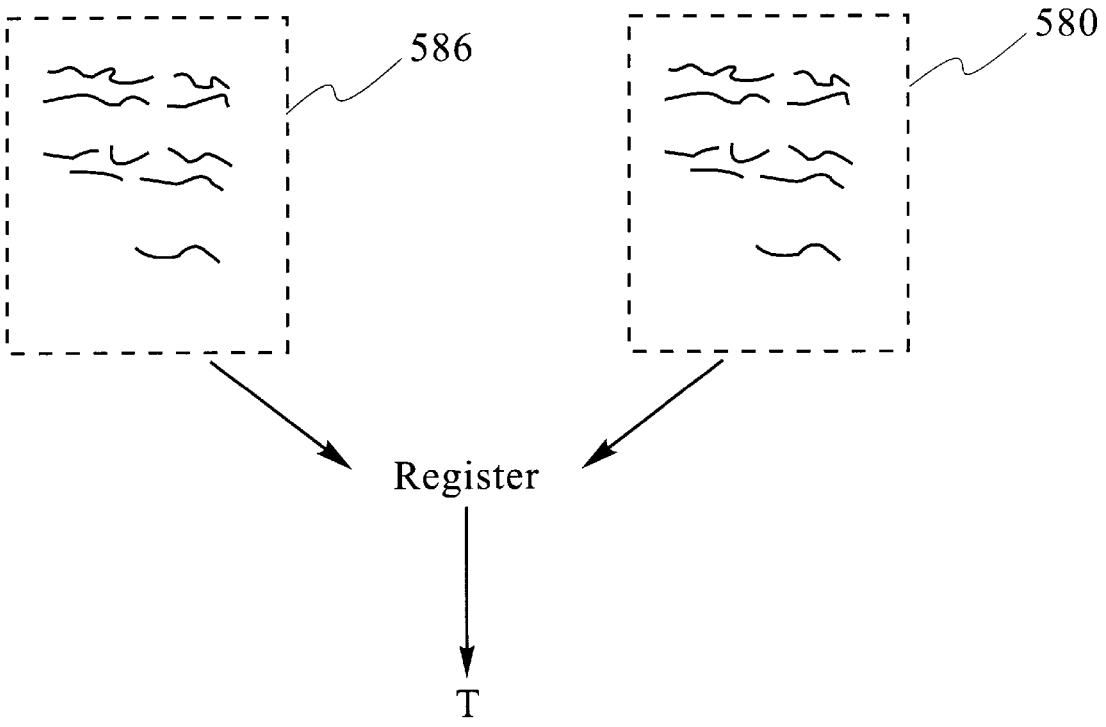
Fir. 6B

METHOD AND APPARATUS FOR PRINTER/SCANNER CALIBRATION

FIELD OF THE INVENTION

The invention relates to data processing, and more particularly, to enabling stored digital information to be printed at a desired location with respect to a sheet, particularly, but not exclusively, a preprinted form.

BACKGROUND OF THE INVENTION

Printing on forms and envelopes is very common in office routine today. The use of word processing apparatus and a computer printer, as opposed to a traditional typewriter, is becoming the preferred way of creating documents. However, at present it remains much easier to print text on a preexisting hard copy form using a typewriter, rather than a computer printer because of the difficulty with a computer printer of aligning text matter with respect to the preprinted information, such as boxes etc, appearing on the form.

For bulk applications, data is usually printed on preprinted forms using some kind of mechanical alignment, such as sprockets and punched paper. Various automatic alignment mechanisms have been proposed for such printers examples of which can be found in U.S. Pat. No. 4,725,156 and the patents discussed therein. However, increasingly printers for general purpose office application do not have such alignment facilities and in any case such apparatus is not suitable for one-off operation.

On the other hand, there is an increasing tendency to make copies of forms available in digital form so that the preexisting form information can be combined with text information within a word processing or specialised form processing application and the completed form printed onto a blank sheet using a computer printer. In some such systems, there is the possibility to use an image of an empty form which has been input to the computer using an image scanner. The scanned image can then be used as a background to allow information to be filled into the form on the screen and then the information printed onto the preprinted form.

Some form processing systems have employed a variety of sophisticated form recognition techniques to allow fields of the form to be automatically recognised in order to facilitate computerised data input and formatting. Such a system is disclosed for instance in U.S. Pat. No. 5,228,100.

Nevertheless, the operation of these systems has been somewhat unsatisfactory because of the difficulty of aligning the filled in information with the preprinted form. Generally, a trial and error approach is required to refine global horizontal and vertical offsets to be applied when printing the image.

This trial and error approach is wasteful in time and in forms. Moreover, some forms, for example cheques, are numbered and the wastage of a form may have to be accounted for in internal processes of an organisation which would add further inconvenience and handling overhead to practical uses of this technique.

In any case, non-uniform distortions may mean that it is not possible to find global offsets that place filled in information in the right places over the whole surface of the form.

U.S. Pat. No. 5,187,774 describes an automatic alignment system for a printer in which a mark is printed on a document having a preprinted reference pattern. The location of the mark with respect to the pattern is observed by an operator and entered into a computer. The program then calculates horizontal and vertical offsets to be applied in order to correct any misalignment of the printer.

However, this system can only generate global horizontal and vertical shifts and is therefore unsuitable for non-linear and/or non-uniform distortions and other effects such as rotation and skew. Furthermore, the accuracy of the alignment is limited to the accuracy with which the operator can discern the position of a printed mark with respect to the preprinted reference pattern.

SUMMARY OF THE INVENTION

This invention aims to mitigate the above-described drawbacks of the prior art by providing an improved arrangement for printing information at a desired location with respect to a sheet.

To achieve this, the invention provides a method for calibrating a printer and/or a scanner so that information can be printed at a desired location with respect to a sheet, the method comprising the steps of: storing a first set of markings as a first image in digital form; printing, using a printer to be calibrated, the first image on a sheet to form a printed sheet; scanning the printed sheet to generate a second image stored in digital form; comparing the first image and the second image, or an image derived from the second image, to determine a first transformation which maps the first set of markings in the second image, or the image derived from the second image, onto the first set of markings on the first image; storing parameters of the first transformation for subsequent use by applying the first transformation to information to be printed at the desired location.

Using this method the bias transformations associated with a printer and/or a scanner can be accurately measured and stored for future use in printing.

The method finds particular application in a system for enabling the filling in of preprinted forms, but would be equally applicable to enabling the addition of information to any other kind of document or any other application where accurate printing is required.

In one simple embodiment the step of storing the first set of markings comprises scanning a preprinted sheet, such as a preprinted form, using a scanner having a feed mechanism. In this case, the step of scanning the printed sheet is carried out using the same scanner and the parameters of the first transformation are stored in a manner identifying the first transformation with the calibrated scanner/printer combination.

This provides an effective method of calibrating a particular scanner and printer combination so that, for instance, forms may be conveniently and accurately filled-in using the calibrated combination without wasting an example of the form.

In other, more sophisticated embodiments, the method comprises storing a second set of markings as a third image in digital form and printing the first set of markings on a sheet on which the second set of markings have previously been printed at a known location to form a composite printed sheet.

In this case, the second image and the third image are compared to determine a second transformation which maps the second set of markings in the second image onto the second set of markings on the third image, the second transformation being applied to the second image and the third image being subtracted from the second image to generate a fourth image. The first image is then compared with the fourth image to determine the first transformation.

For example, in a second embodiment, the step of storing the second set of markings comprises scanning a preprinted form and the step of storing the first set of markings comprises enabling, via user input means, a user to fill in the form by entering information at desired locations with respect to the form image. The form image is then stored for future use when information is to be printed on the preprinted form, the parameters of the first transformation being stored in a manner identifying the first transformation with a particular printer and the stored second image.

Whilst this technique would waste an example of a form, it is advantageous in that effectively the transformation can be determined from only a single scan operation. A form drop-out or template elimination operation effectively removes the transformation applied by the second scan operation. This makes the technique suitable for use with a flat-bed scanner which cannot be reliably calibrated.

In a third and preferred embodiment, a scanner and a printer are calibrated separately, but in a single calibration process, using predefined reference patterns as the first and second sets of markings. The reference patterns are prestored and form the first and third images respectively. One reference pattern is printed on a sheet on which the other reference pattern has previously been printed at a known location to form the composite printed sheet.

In this case, the parameters of the second transformation represent the transformation associated with the scanner and are stored for subsequent use in correcting information entered using that scanner. The parameters of the first transformation represent the transformation associated with the printer.

In preferred embodiments, at least one of said comparing steps comprises dividing the first and second images into blocks and, for each block, comparing corresponding blocks to determine a transformation which maps markings in the block in the first image to markings in a corresponding block in the second image and at least one of the comparing steps comprises registering the images at the pixel level.

A second aspect of the invention provides a data processing system including a printer and a scanner and a calibration mechanism for the printer and/or the scanner, which mechanism is arranged to operate according to a method of the above described type. The system can include user interface means for enabling a user to fill in a preprinted form with reference to an image of a preprinted form scanned via the scanner.

Also provided is a data processing system including a printer, the system being arranged to print stored information by retrieving stored transformation parameters and applying a corresponding transformation to said information to be printed, which transformation parameters have been generated using a method of the above described type.

BRIEF DESCRIPTION OF THE DRAWINGS

Embodiments of the invention will now be described by way of example only with reference to the accompanying schematic drawings, wherein:

FIG. 2 illustrates a basic method of operation by which a form is filled in;

FIGS. 6A and 6B illustrate the learning phase in a second embodiment;

DETAILED DESCRIPTION OF THE INVENTION

Figure 1:
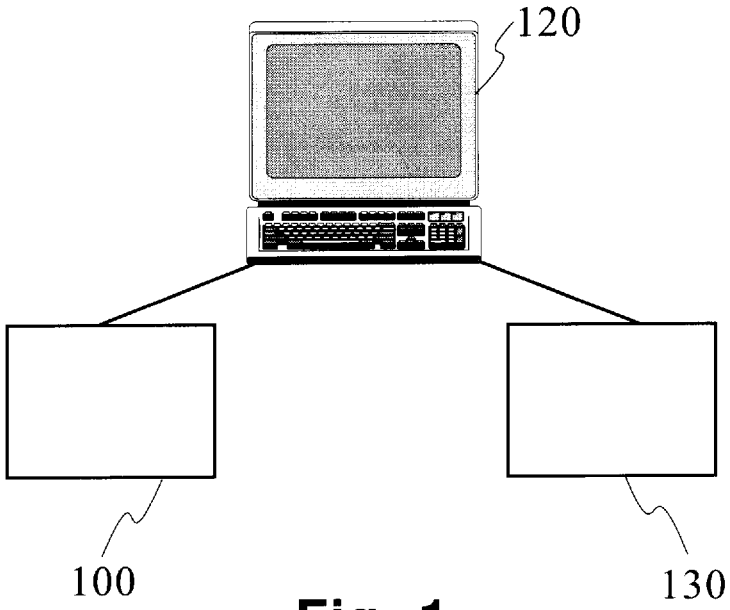
FIG. 1 shows apparatus for filling in a preprinted form.

Referring to FIG. 1 there is shown apparatus for printing information on a preprinted form. The apparatus comprises an image scanner 100, a suitably programmed general purpose computer 120 and a printer 130. It will be understood that scanner 100, computer 120 and printer 130 may be of any suitable mutually compatible conventional types and may be interconnected in any suitable way either directly or via a network. Computer 120 is programmed in a suitable manner to perform the image and text processing tasks described below.

It will be understood that the techniques to be described below may equally be carried out in hardware or software or any combination thereof and, furthermore, may equally be carried out, in whole or in part, by suitable hardware or software logic provided in either scanner 100 or printer 130.

Figure 2:
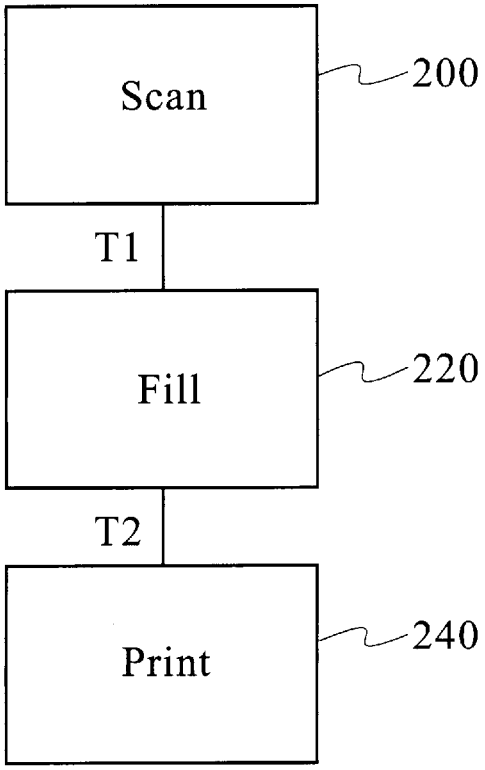

The basic method of operation by which a form is filled in using the above described apparatus is shown in FIG. 2. A preprinted form is scanned using scanner 100 in step 200. The preprinted form is displayed to the user and the user enabled to create a document with reference to the displayed form in fill step 220. The form image may be displayed as a backdrop for the user to fill in the spaces on the form using any suitable text or graphical processing techniques and with the aid of a graphical user interface so that the filled in information is superimposed over the form backdrop.

A document is thereby created which includes only the filled in information, but at locations determined with reference to the displayed scanned form. This document will be referred to in the following description as the Fill file. Note that the Fill file contains only the information entered by the user and not that of the form itself.

It will be understood that a variety of sophisticated form recognition and processing and user interface techniques, such as those described in U.S. Pat. No. 5,228,100, may be employed to assist in the generation of the Fill file. These aspects will not be discussed in detail herein since they are not directly relevant to this invention, except insofar as they may benefit from accurate printing of the information in the Fill file in order to enable maximum advantage to be taken of modern text and graphics processing facilities.

The Fill file is then printed onto a preprinted form in step 240.

Whenever the Fill file is printed on the form there is generally a bias which causes the printed text to be printed in a displaced location. This bias is printer dependent and is represented in FIG. 2 by the transformation T2. If the form is scanned by a scanner in order to enable the user to locate the text on the form as described above, the scanner then adds its own bias which is represented in FIG. 2 by transformation T1.

The transformations T1 and T2 are generally linear and include distortions such as translation and rotation. However, since both scanner and printer are mechanical devices, some non-linear distortions may also be present. The result of these effects is that the printed text is misplaced on the form in an undesirable manner.

The system described herein is arranged to print the information on the desired form in the right locations, the hardware biases being compensated for by appropriate software that adjusts the information on the page.

To compensate for the biases of the printer and scanner, the process by which a form is filled is divided a learning phase in which the hardware biases are determined using a calibration process, and a usage phase in which desired information is printed on a preprinted form.

It is assumed herein that the printer has an automatic feed mechanism designed to feed sheets to be printed in a consistent fashion with respect to a printing mechanism so that the printer may be reliably calibrated.

A distinction is drawn between the use of a scanner having an automatic feeder designed to feed sheets to be scanned in a consistent fashion with respect to the scanning mechanism, and a flat bed scanner, in which the forms are placed manually on a platen in the scanner.

The technique used for determining the desired mapping transformation is slightly different for these two situations because in the automatic feed scanner, the bias transformation caused by the scanner is expected to be the same for each different scan trial. Consequently, the scanner can be reliably calibrated.

By contrast, in the FB-mode the scanner transformation may not be reliably learned in advance since for each scan operation the user may put the page inside the scanner in a slightly different location and/or orientation on the platen.

It will be understood that the technique described below for flat-bed scanners may also be used for auto-feed scanners. Moreover, the automatic feed mechanisms may be of any type which are designed to feed sheets to be scanned in a consistent fashion with respect to the printing and/or scanning mechanisms, including via the use of traditional mechanical alignment mechanisms such as sprockets and punched paper.

Note that the calibrations of the scanner and/or printer, expressed in the details of displacement of the information, is hardware specific and should be carried out once for each hardware configuration. That is, replacing, changing or tuning any of these hardware components should be followed by repeating the calibration process. The calibration process may be carried out at any time. It may also be carried out prior to the usage phase with the desired form to be filled.

Moreover, it is thought that in some situations the biases of the printer and/or scanner may include a random or otherwise inconsistent element as well as a systematic element. Consequently, it may be desirable in some circumstances to repeat the calibration exercise in order to refine the measured parameters of the transformations. Any such inconsistent element will inevitably limit the precision with which information may be printed on the form.

1. The Learning Phase

Figure 3:
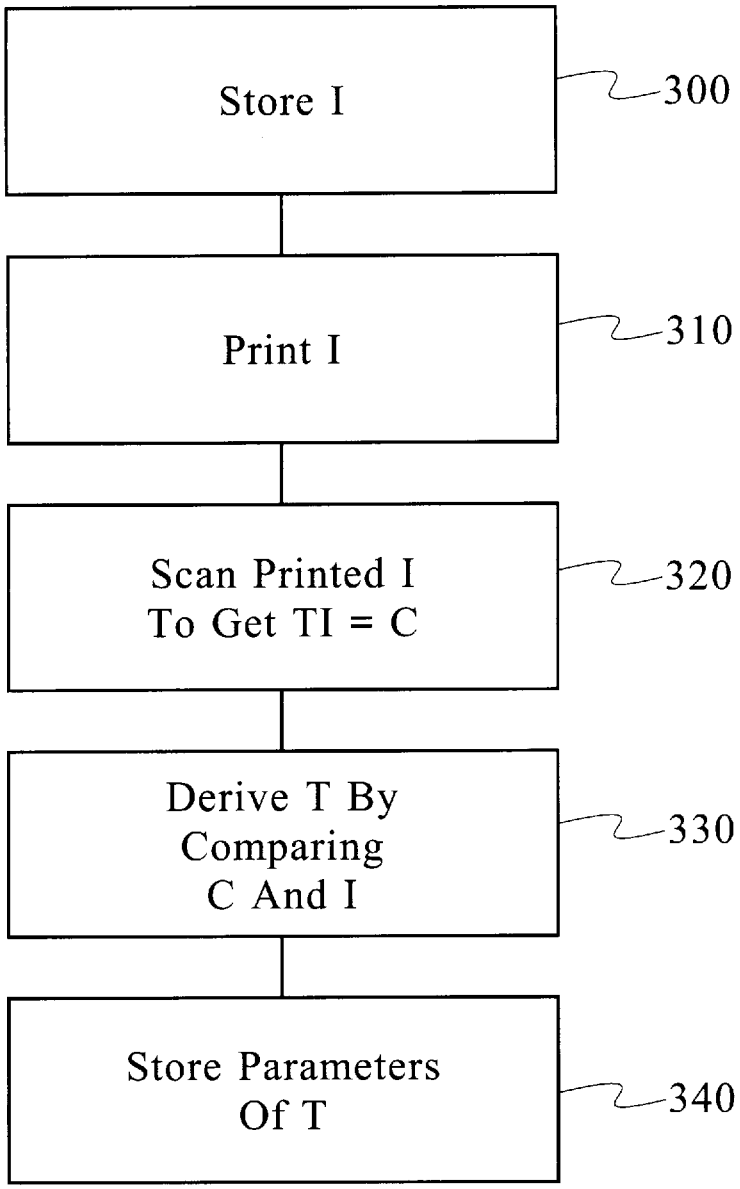
FIG. 3 is a flow diagram illustrating the learning phase.

The basic method used in the learning phase is illustrated in FIG. 3. A first digital image I is generated (step 300) and stored in computer 120. Image I comprises a first set of markings.

Image I is printed using a printer to be calibrated in step 310 and then scanned using a scanner in step 320. This results in a second stored image C.

A transformation T which maps the first set of markings in image C to the first set of marking on image I is then derived in step 330 by comparing I and C or an image derived from C using an image registration process. The parameters of this transformation are then stored in step 340 and can then be used as a compensation transformation to adjust the text on the page when printing on the preprinted form.

There are a number of image registration techniques known in the art for various applications. The image registration technique used in these embodiments is the block-wise registration technique described in European Patent Application number 411 231 of IBM Corporation. Assuming that local distortions are small and piecewise linear, the images to be registered are broken into small, slightly overlapping blocks and histogram correlation is used to find the relative offsets of corresponding blocks.

A consistency conserving process is used to ensure there are no conflicts between the offsets computed for neighbouring blocks. In cases where there is not enough information in the histogram to compute offsets for particular blocks, the offsets for neighbouring blocks are used. Full details may be found in EP-A-411 231 which is incorporated herein by reference. It will be understood that the computed transformation is parametrised by the offsets to be applied to each block and these may be stored in a suitable format.

Another suitable registration technique which has been found to be more effective for fine distortions is described in International Patent Application WO95/14348. Other registration techniques are described in publications referred to in EP-A-411 231.

Any suitable technique which enables the transformation linking markings in one image to equivalent markings in another image may be used. Moreover, the comparison need not be at the pixel level, but may for example simply compare the positions of particular characters in the images, the choice of technique depending largely upon the precision required.

Embodiment 1

Figure 4:
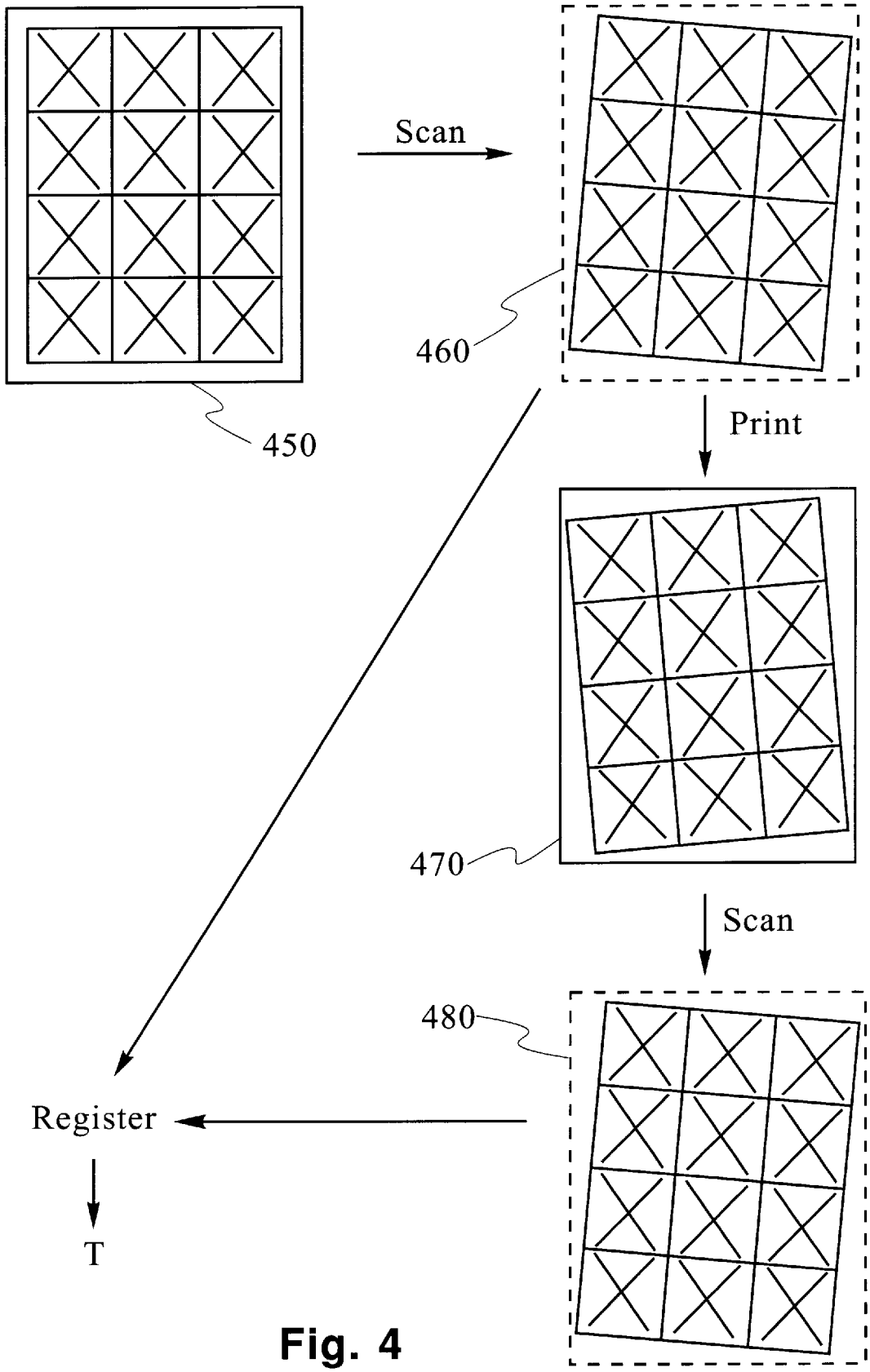
FIG. 4 illustrates the learning phase in a first embodiment.
Figure 5:
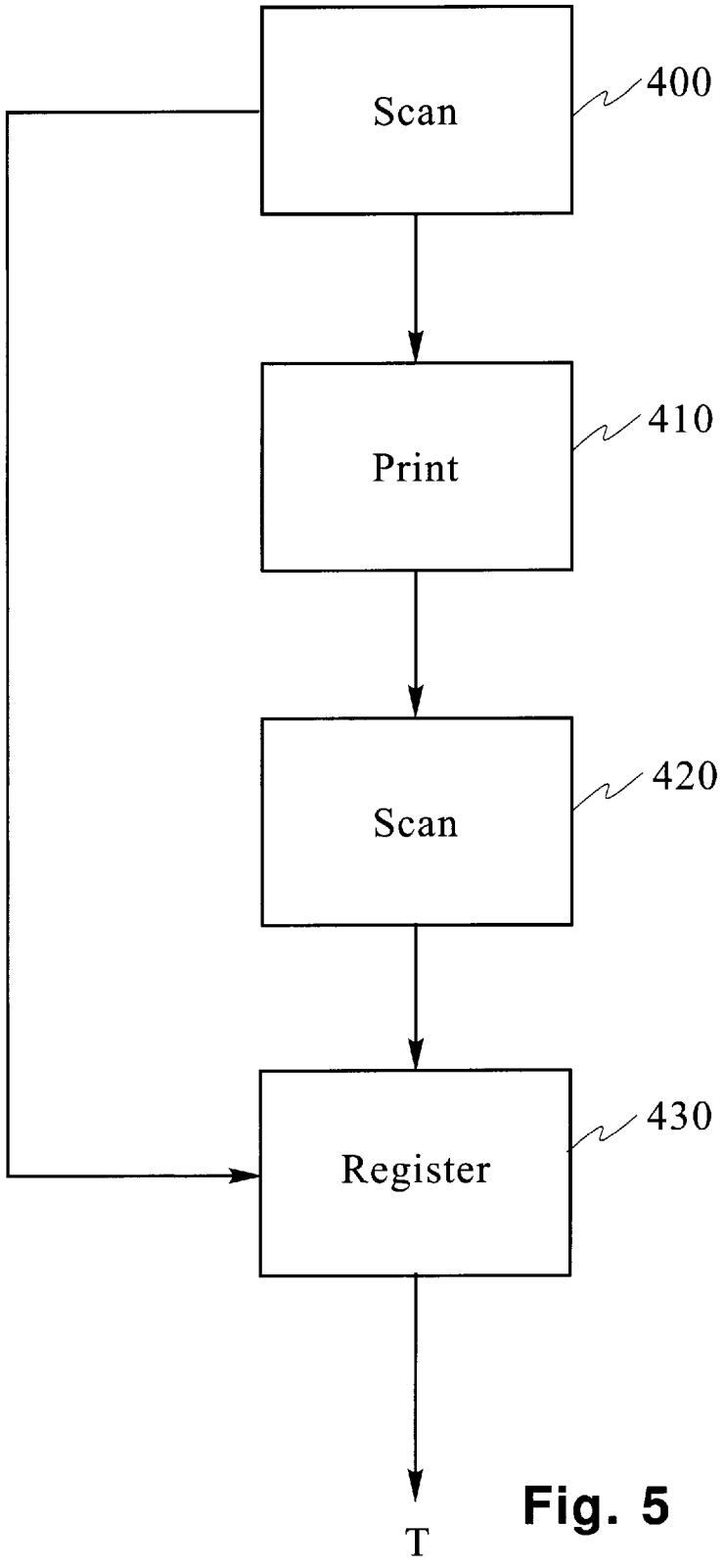
FIG. 5 is a flow diagram illustrating the learning phase in a first embodiment.

A first simple embodiment of the learning phase which is suitable for an auto-feed scanner is illustrated in FIG. 4 and in the corresponding flow diagram of FIG. 5. In FIG. 4, digitally stored images are indicated by a dashed boundary, whilst images on printed sheets are indicated by a solid boundary.

A document 450 having markings on its surface is scanned in step 400. The document may be a preprinted form, or may be any other document, such as a specially marked document used for calibration. To enable local transformations to be determined over the whole document, it is preferable that the markings on the document extend over the whole of its surface and that the markings be such that small distortions, such as translations or rotations be detectable.

The output of the scan operation is a file containing the digitized image 460 of the document. This will be referred to as the Form file and corresponds to the stored image I in FIG. 3. The form file is printed in step 410 to yield the printed form 470. This printed form is then scanned in step 420 to yield the D-Form file (displaced form file) 480 corresponding to image C in FIG. 3. The D-Form image is displaced with respect to the original Form image by a transformation T=T1T2, where T2 is the printer transformation, T1 is the scanner transformation, and T is the overall transformation between the two images.

The distortions introduced by the printing and scanning operations are illustrated in greatly exaggerated form in FIG. 4.

The D-Form image is compared with the scanned image of the original form in step 430. The comparison is carried out by a block-wise registration technique between the image of the original form with that of the printed form image. The outcome of this registration is the desired bias transformation T of the particular scanner/printer combination, which compensates also for non-linear distortions. The transformation is then stored in a manner identifying the first transformation with the calibrated scanner/printer combination, such as in a suitable table, for future use with the same printer/scanner combination in a usage phase to be described below.

If the document used for calibration is itself a preprinted form, then the form image may also be stored for future use when it is desired to fill-in this particular form, in which case no further scanning operation would be required in the usage phase.

In practice, with this first embodiment, it is envisaged that where a number of printers and scanners are connected to a network and made available for use within an organisation, the transformation information determined in the above described calibration operation be stored for each scanner/printer combination. If the scanned form images are stored together with the transformations, then it would only be necessary to store transformation information for each printer if these scanned images are used in the usage phase.

Embodiment 2

The second embodiment is suitable for a flat bed scanner in that it does not rely on being able to reliably calibrate the scanner. At least two identical copies of the original form are required to be available since one original copy is used on learning the local scanner transformation.

Figure 6A:
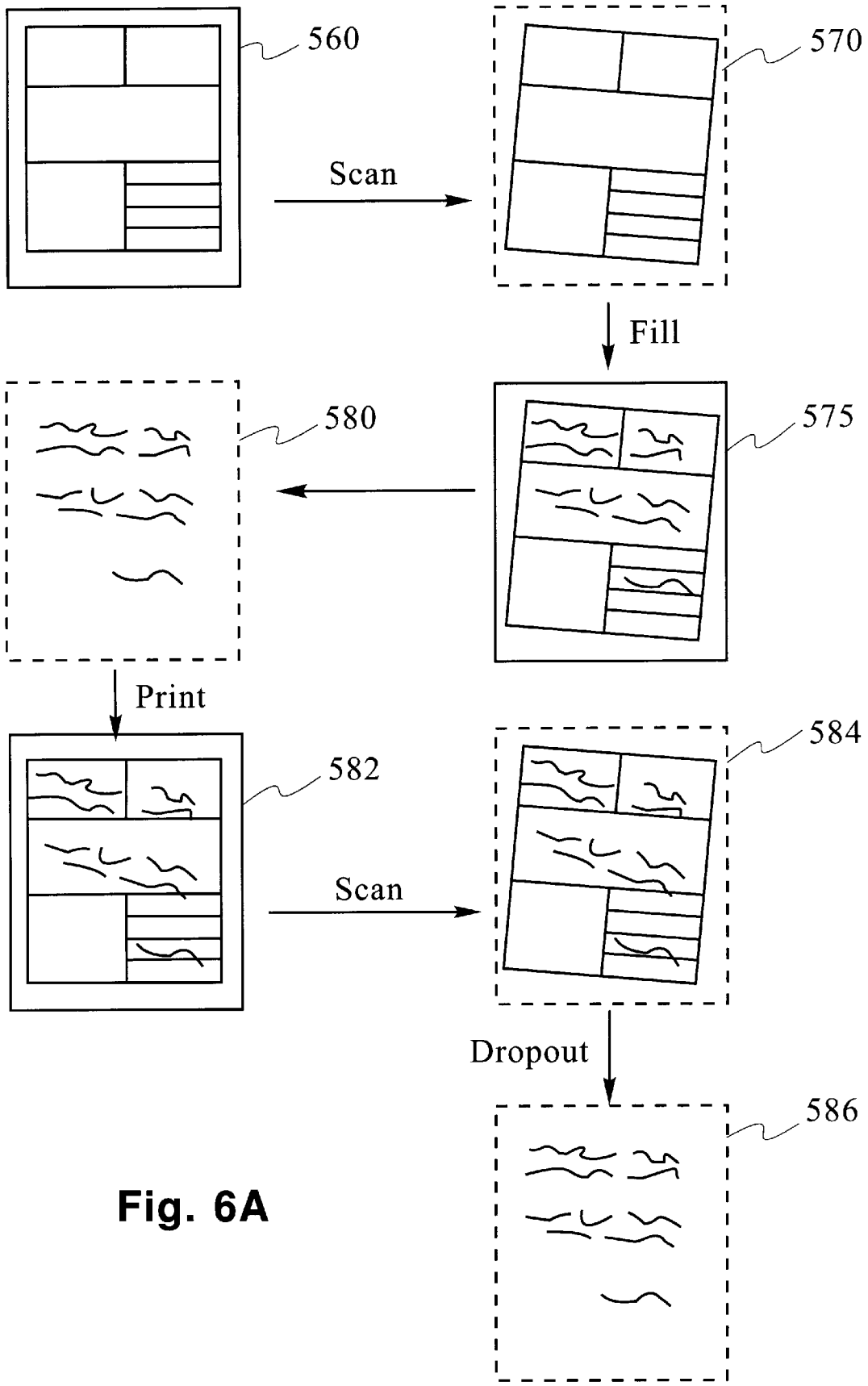
Figure 7:
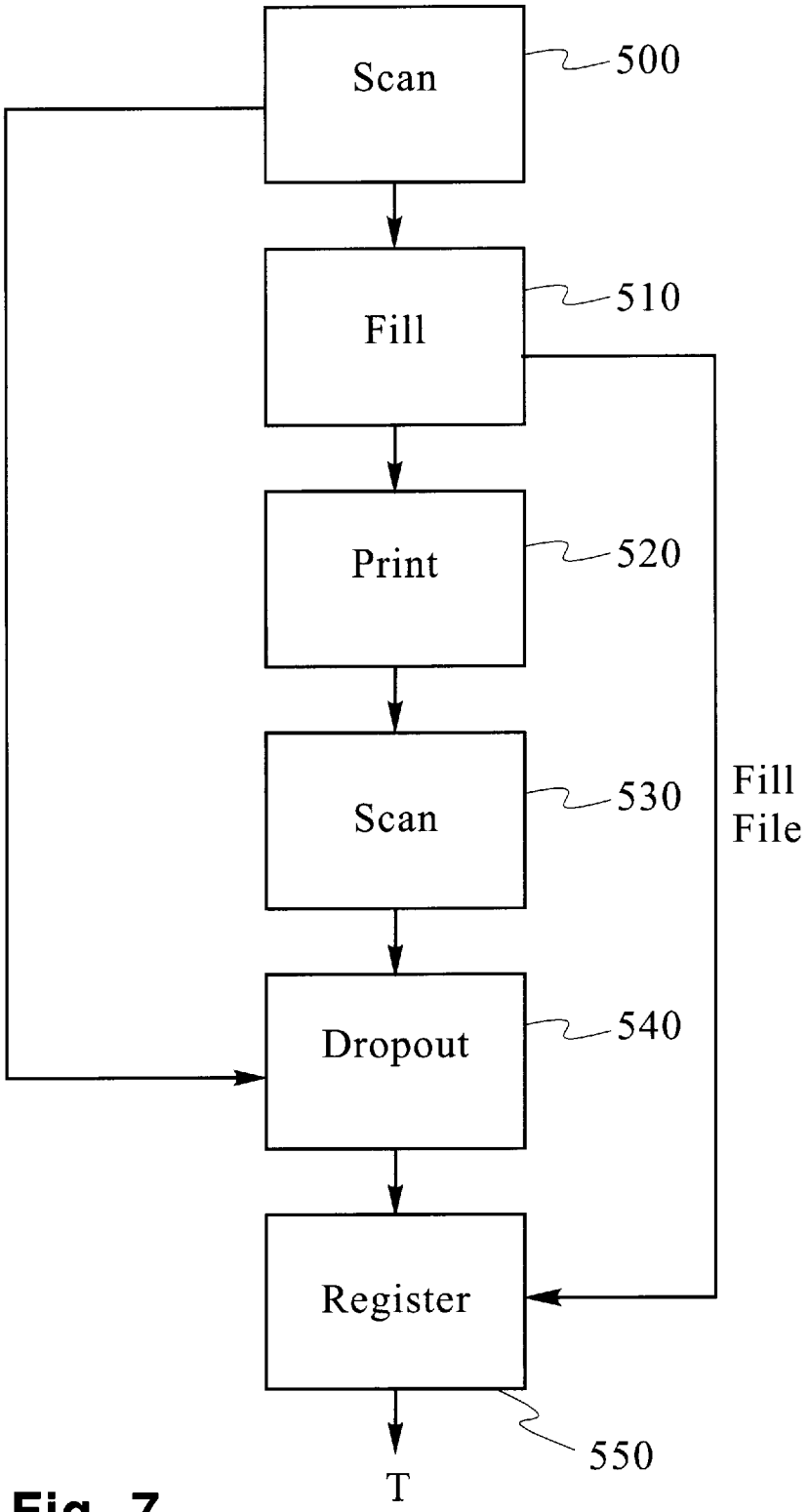
FIG. 7 is a flow diagram illustrating the learning phase in a second embodiment.

This procedure is illustrated in FIGS. 6A and 6B and in corresponding flow diagram of FIG. 7. In FIGS. 6A and 6B, digitally stored images are indicated by a dashed boundary, whilst images on printed sheets or displayed on a display screen are indicated by a solid boundary.

An original preprinted form 560 is scanned in step 500 to yield the Form file 570 which is displayed on the computer screen and filled-in by the user via a graphical user interface or the like in step 510. The filled in image is shown at 575. The content of the form filled by the user is stored in a Fill file 580. The Fill file corresponds to the image I referred to in connection with FIG. 3.

This Fill file is then printed in step 520 on the preprinted original form 560, where typically the text will be displaced with respect to the desired position. This printed page 582, referred to as the Displaced filled page, is then scanned in step 530 to yield the DF-Form file 584. The DF-Form file corresponds to the image C in FIG. 3 and contains two distortions with respect to the original form. One is due to the displacement of the form itself, and one is due to the displacement of the text with respect to the form. These two transformations are then learned.

The distortions introduced by the printing and scanning operations are illustrated in greatly exaggerated form in FIGS. 6A and 6B.

First, a form dropout operation is used in step 540 between the DF-Form and the Form, used as the template form, to register between these two images and subtract the Form content from the DF-form image.

Form dropout or template elimination is an image processing technique which has been developed for removing a template image of an empty form from a composite image which comprises filled-in information superimposed upon a form structure. The process includes a registration operation which aligns the form structure in the template with that in the composite image. An image subtraction operation is then used to remove the template from the composite image, leaving only the filled in information. The above referenced EP-A-411 321 describes the form dropout technique in detail.

The output of the form dropout procedure will be referred to as the R-fill file 586, which contains now only the text distortions with respect to their desired location. The form drop-out operation effectively removes the transformation applied by the second scan operation 530.

Then, the registration procedure is invoked in step 550 between the R-fill file 586 and the Fill file 580 which determines the transformation T between the text in the R-Fill file and its desired location.

Finally, the transformation T and the scanned original form can be stored in a manner identifying the transformation T with a particular printer and the stored form, such as in a suitable table, for future use when the same form is desired to be filled with the same printer. Alternatively, the Fill file can be printed on the form immediately as described below in relation to the usage phase.

Thus in this second embodiment, the learning phase needs to be carried out once for each form/printer combination.

Embodiment 3

In the third, and preferred, embodiment the transformations for the printer and scanner may be learned and stored separately by the use of two special reference images.

Figure 8A:
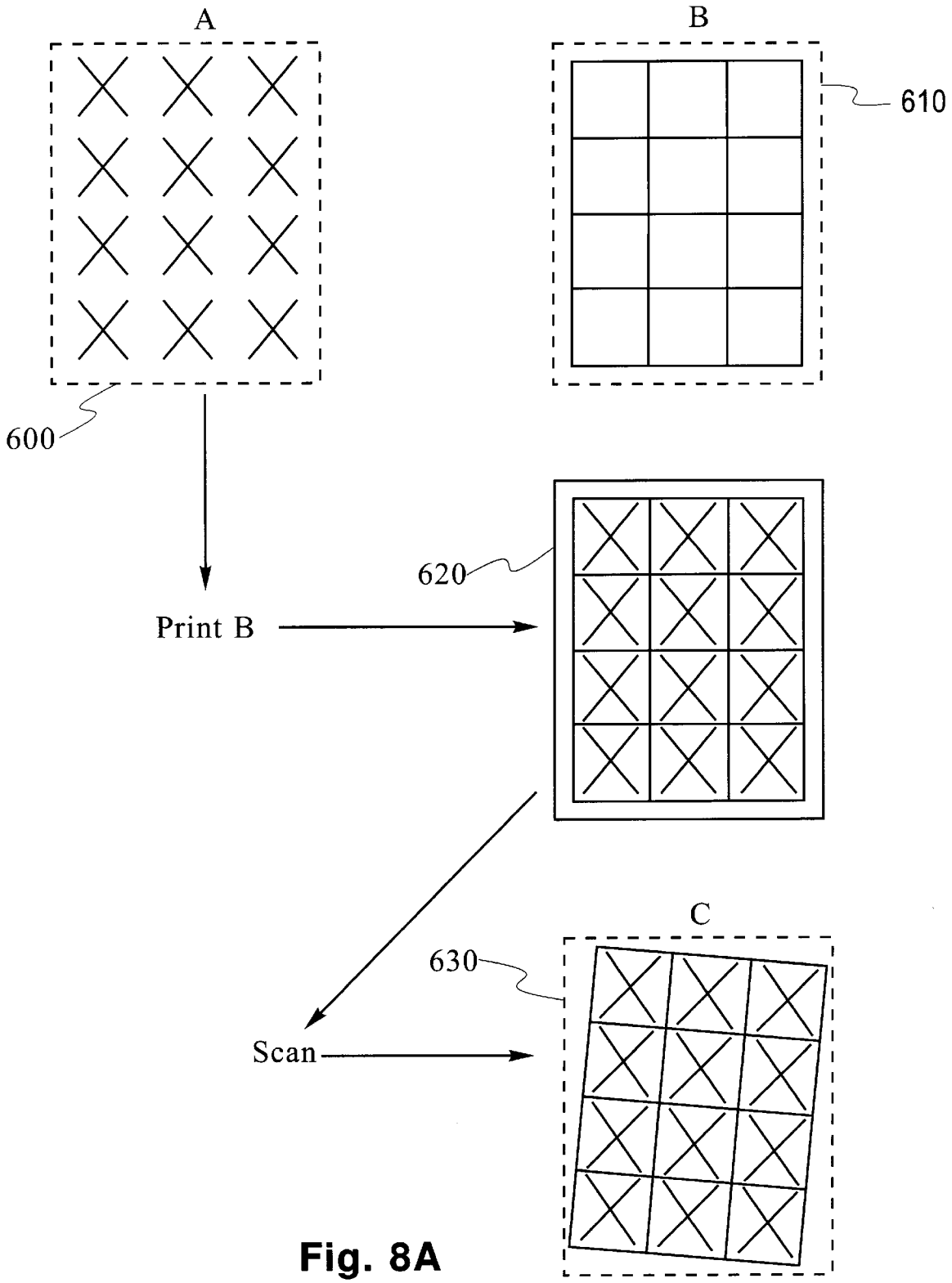
FIGS. 8A and 8B illustrate the learning phase in a third embodiment.
Figure 8B:
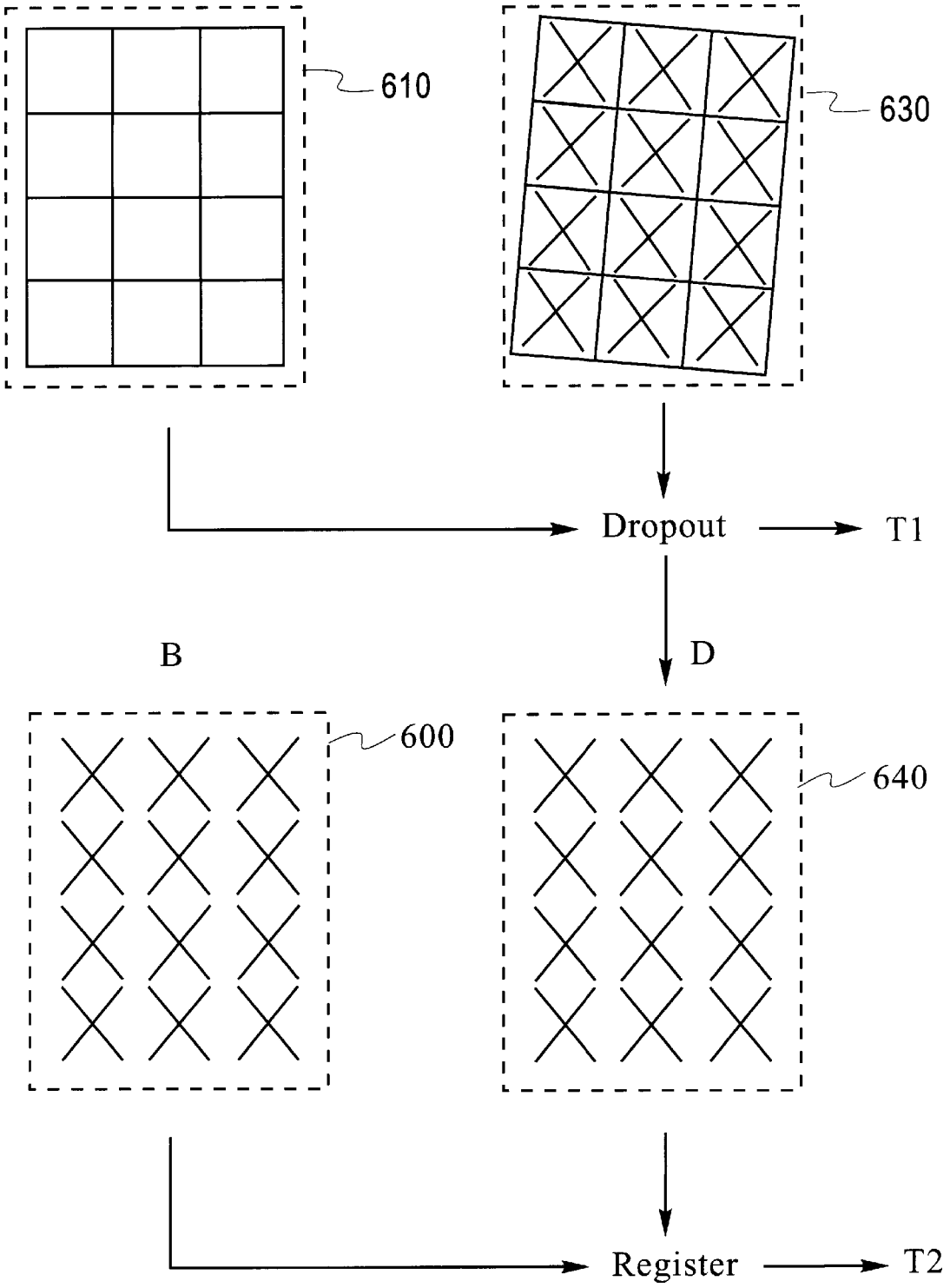
Figure 9:
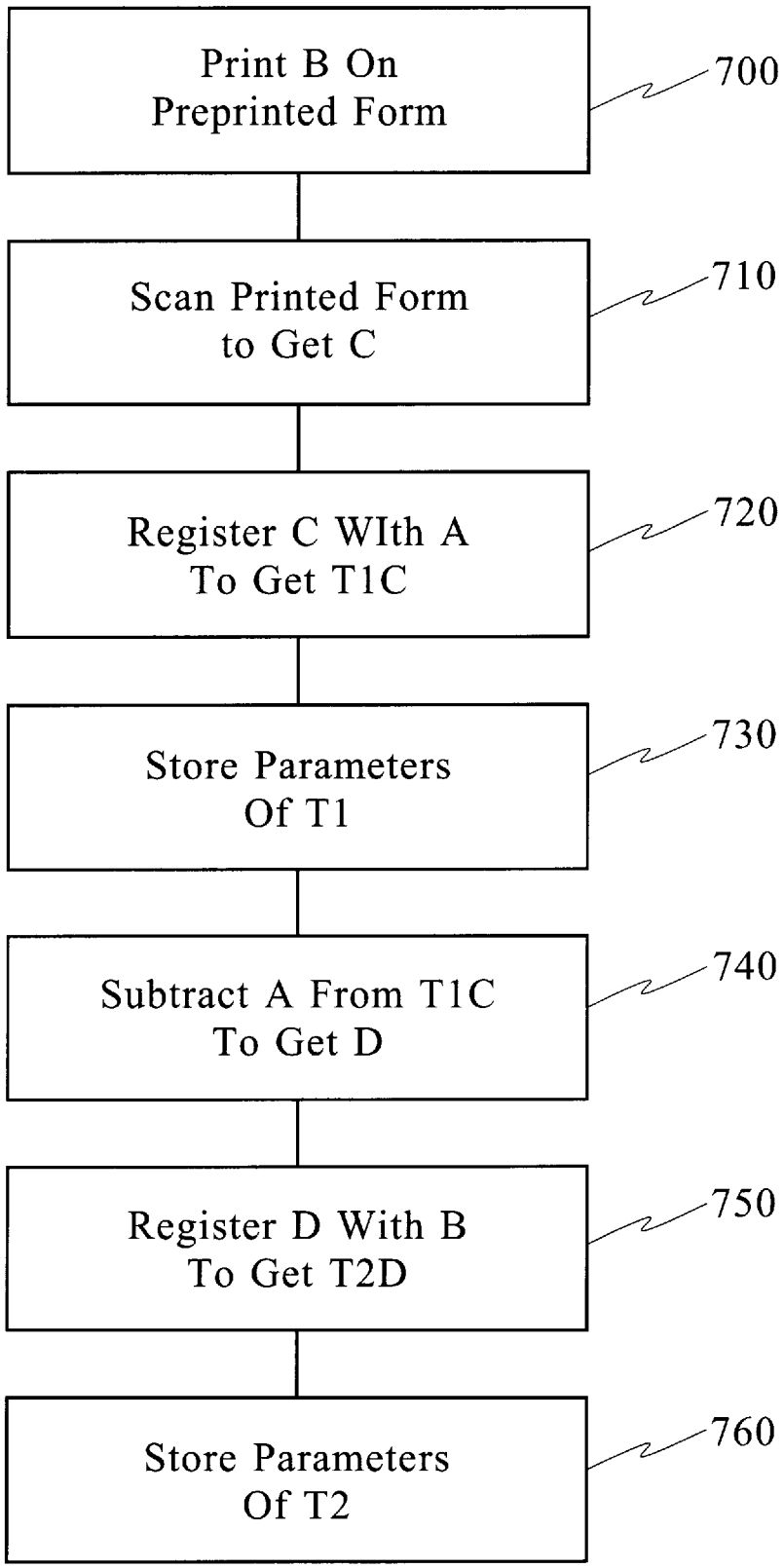
FIG. 9 is a flow diagram illustrating the learning phase in a third embodiment.

The process is illustrated schematically in FIGS. 8A and 8B and the steps of the process are shown in flow diagram form in FIG. 9. In FIGS. 8A and 8B, digitally stored images are indicated by a dashed boundary, whilst images on printed sheets are indicated by a solid boundary.

Two distinct reference images A and B, reference numerals 600 and 610 respectively, are prepared and stored in computer 120. The images contain first and second sets of markings respectively. Also prepared is a preprinted sheet on which one of the sets of markings, in this case image B 610, is printed at its correct location.

The images A and B can be any kind of image which facilitates the registration operations. It is preferable that the markings of image B be dominant since it will be used as a template for a form dropout operations as described below. It will be appreciated that the reference images may be optimised for the characteristics and performance of the particular registration techniques used.

The first image 600 is printed in step 700 on the preprinted sheet to yield a printed composite sheet 620. The printed composite sheet 620 is then scanned in step 710 to yield a scanned image C, 630.

The distortions introduced by the printing and scanning operations are illustrated in greatly exaggerated form in FIGS. 8A and 8B.

A form dropout operation as described above is applied with the image B being used as a template to be removed from scanned image C 630. This operation comprises the steps of registering C with A to obtain an intermediate image T1C, step 720 and subtracting A from T1C to obtain an image D 640, step 740. The parameters of transformation T1 are stored in step 730. These represent the transformation introduced by the scanner.

Image D 640 is then registered in step 750 with image B to obtain a transformation T2 and the parameters of this transformation are also stored in step 760. This is the transformation associated with the printer.

Using this third embodiment, it is envisaged that where a number of printers and scanners are connected to a network and made available for use within an organisation, the transformation information determined in the above described calibration operation be stored for each scanner and for each printer in a manner identifying the particular printer and the particular scanner, such as in suitable tables. When a scanner is used in combination with a printer to fill a form as described above in connection with FIG. 2, then the transformations can be combined.

2. The Usage Phase

Embodiment 1

Figure 10:
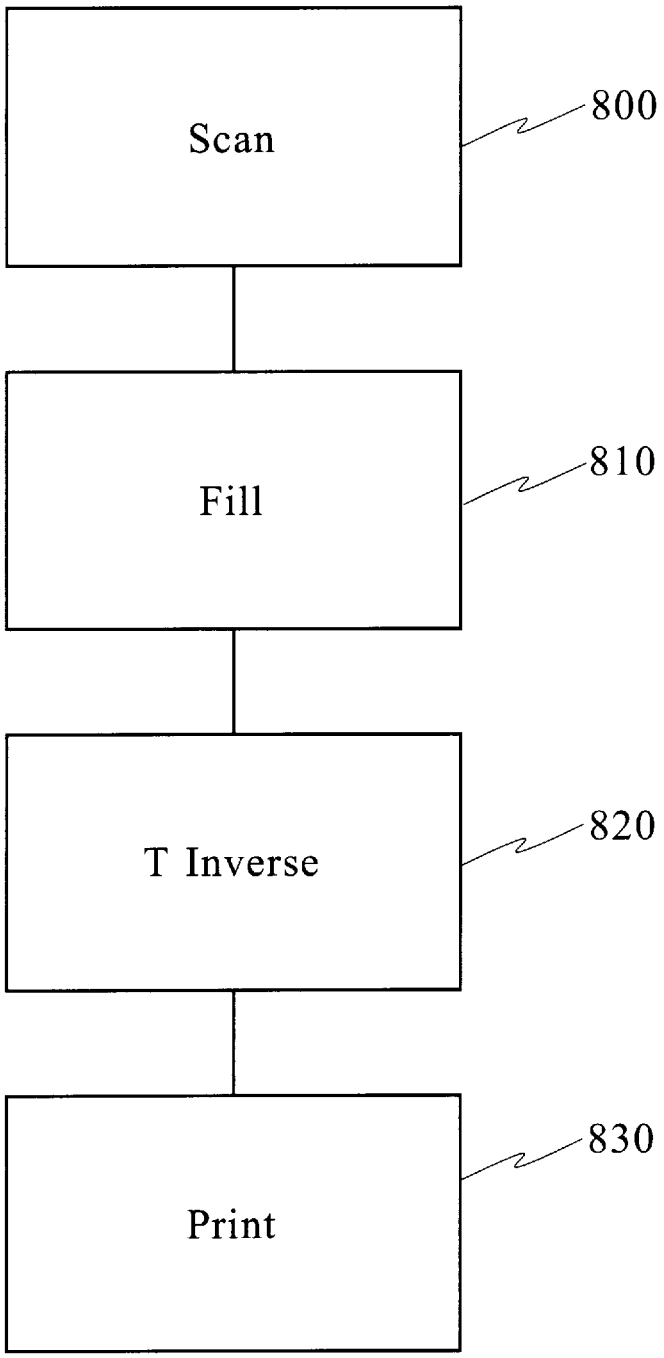
FIG. 10 is a flow diagram illustrating the usage phase.

The process is illustrated in FIG. 10. There is a given preprinted form to be filled by some desired text. The user scans the form in step 800 and displays it on the computer screen. The desired text is then entered in step 810 by the user in the desired locations on the scanned form via a suitable text processing application and this text is stored in a Fill file. The Fill file is then processed in step 820 by a software process that uses the previously learned transformation computed and stored in the learning phase for a particular scanner/printer combination. A Corrected Fill file is created in which the location of the text is compensated to overcome the hardware biases. Then, the Corrected Fill file is printed in step 830 on the original form which is fed into the printer.

Embodiment 2

If the transformation appropriate to a particular printer has been stored together with the image of a particular form, then this information and the soft copy of the form can be recalled. The desired text is then entered as described above by the user in the desired locations on the scanned form via a suitable text processing application and this text is stored in a Fill file.

Alternatively, in embodiments where the learning phase is carried out immediately before the usage phase, the Fill file from the learning phase, step 510, can be used directly and the user need not enter the information a second time.

The Fill file is processed by applying the stored transformation to yield the C-fill file, in which the text coordinates and orientation are compensated for their misalignments. Then, to get the Filled page, the user prints the C-file on the second copy of the original page. This printing procedure may be repeated as many times as required to get multiple filled pages.

Embodiment 3

The third embodiment allows a more flexible usage of the Fill File since the calibrations of the printer and scanner can be used either in combination or independently.

The Fill file can be created with respect to a scanned preprinted form as described above and the combination of the printer and scanner transformations used to print the Fill file. Alternatively, the Fill file may be created with respect to an image of a form which has either been created specially for the purpose, such as one of the images 600 or 610 or which has been previously scanned and stored. The form images and or the Fill files can be transformed using the scanner transformation and stored. In this way, they can be processed and even communicated in a 'standard', format between users. Only knowledge of the printer transformation is required in order to print them, or Fill files created with respect to them in the case of form images, in the correct location.

It will be appreciated that there are many other applications of the kind of calibration of printers and/or scanners described above and that such application is not limited to the particular form filling application described.

As will be clear from the above description, the present implementation of the invention takes the form of a computer program and can be distributed in the form of an article of manufacture comprising a computer usable medium in which suitable program code is embodied for causing a computer to perform the functions described above.

The invention is applicable to the industrial fields of data processing, printing, office automation and other areas.

What is claimed is:

1. A method for calibrating a printer and/or a scanner so that information can be printed at a desired location with respect to a sheet, the method comprising:

storing a first set of markings as a first image in digital form;

printing, using a printer to be calibrated, the first image on a sheet to form a printed sheet;

scanning the printed sheet to generate a second image stored in digital form;

comparing the first image and the second image, or an image derived from the second image, to determine a first transformation which maps the first set of markings in the second image, or the image derived from the second image, onto the first set of markings on the first image;

storing parameters of the first transformation for subsequent use by applying the first transformation to information to be printed at the desired location;

storing a second set of markings as a third image in digital form;

printing the first set of markings on a sheet on which the second set of markings are printed at a known location to form a composite printed sheet;

comparing the second image and the third image to determine a second transformation which maps the second set of markings in the second image onto the second set of markings on the third image;

applying the second transformation to the second image;

subtracting the third image from the second image to generate a fourth image;

comparing the first image and the fourth image to determine the first transformation.

2. A method as claimed in claim 1, wherein the step of storing the second set of markings comprises scanning a preprinted form having the second set of markings printed thereon and the step of storing the first set of markings comprises enabling, via user input means, a user to enter information at desired locations with respect to the second set of markings in the third image, the third image being stored for future use when information is to be printed on the preprinted form, the parameters of the first transformation being stored in a manner identifying the first transformation with a particular printer and the stored second image.

3. A method as claimed in claim 1, wherein the first and second sets of markings are predefined reference patterns, the method comprising storing parameters of the second transformation for subsequent use by applying the second transformation to information to be printed at the desired location, which information has been generated within a computer with reference to an image scanned by a scanner, the parameters of the first transformation being stored in a manner identifying the first transformation with a particular printer and the parameters of the second transformation being stored in a manner identifying the second transformation with a particular scanner.

4. A method as claimed in any one of claims 1, 2, or 3, in which at least one of the comparing steps comprises registering the images at the pixel level.

5. A data processing system for calibration of a printer, said system comprising:

means for storing a first set of markings as a first image in digital form;

means for printing on said printer to be calibrated the first image on a sheet to form a printed sheet;

means for scanning the printed sheet to generate a second image stored in digital form;

means for comparing the first image and the second image, or an image derived from the second image, to determine a first transformation which maps the first set of markings in the second image, or the image derived from the second image, onto the first set of markings on the first image;

means for storing parameters of the first transformation for subsequent use by applying the first transformation to information to be printed at the desired location;

means for storing a second set of markings as a third image in digital form;

means for printing the first set of markings on a sheet on which the second set of markings are printed at a known location to form a composite printed sheet;

means for comparing the second image and the third image to determine a second transformation which maps the second set of markings in the second image onto the second set of markings on the third image;

means for applying the second transformation to the second image;

means for subtracting the third image from the second image to generate a fourth image;

means for comparing the first image and the fourth image to determine the first transformation.

6. A data processing system as claimed in claim 5, wherein the first and second sets of markings are predefined reference patterns, the system comprising means for storing parameters of the second transformation for subsequent use by applying the second transformation to information to be printed at the desired location, which information has been generated within a computer with reference to an image scanned by a scanner, the parameters of the first transformation being stored in a manner identifying the first transformation with a particular printer and the parameters of the second transformation being stored in a manner identifying the second transformation with a particular scanner.

7. A data processing system as claimed in claim 5, in which said means for comparing the first image and the second image comprises means for dividing the first and second images into blocks, and for each block, comparing corresponding blocks to determine a transformation which maps markings in the block in the first image to markings in a corresponding block in the second image.

8. A data processing system as claimed in claim 5, in which said means for comparing the first image and the second image comprises means for registering the images at the pixel level.

9. A data processing system as claimed in claim 5, including user interface means for enabling a user to fill in a preprinted form with reference to an image of a preprinted form scanned via the means for scanning.

* * * * *